US009102048B2

(12) United States Patent
Kuehne et al.

(10) Patent No.: US 9,102,048 B2
(45) Date of Patent: Aug. 11, 2015

(54) SANDER HAVING TWO-PIECE FAN

(71) Applicants: Brent A. Kuehne, Newark, DE (US); Earl Kelican, Jr., Newark, DE (US); Xin Lei Wang, Suzhou (CN); Feng Chen, Suzhou (CN); Pei Zhong Zhen, Suzhou (CN)

(72) Inventors: Brent A. Kuehne, Newark, DE (US); Earl Kelican, Jr., Newark, DE (US); Xin Lei Wang, Suzhou (CN); Feng Chen, Suzhou (CN); Pei Zhong Zhen, Suzhou (CN)

(73) Assignee: BLACK & DECKER INC., Newark, DE (US)

( * ) Notice: Subject to any disclaimer, the term of this patent is extended or adjusted under 35 U.S.C. 154(b) by 18 days.

(21) Appl. No.: 14/232,971

(22) PCT Filed: Nov. 29, 2013

(86) PCT No.: PCT/CN2013/088171

§ 371 (c)(1),
(2) Date: Jan. 15, 2014

(87) PCT Pub. No.: WO2015/077988

PCT Pub. Date: Jun. 4, 2015

(65) Prior Publication Data

US 2015/0151422 A1 Jun. 4, 2015

(51) Int. Cl.

| | |
|---|---|
| ***B25F 5/00*** | (2006.01) |
| ***B24B 55/10*** | (2006.01) |
| ***B24B 23/04*** | (2006.01) |

(52) U.S. Cl.

CPC ..... *B25F 5/008* (2013.01); *B24B 23/04* (2013.01); *B24B 55/10* (2013.01); *B24B 55/105* (2013.01)

(58) Field of Classification Search

CPC ..... A47L 11/12; B24B 23/02; B24B 23/03; B24B 23/04; B24B 55/105; B25F 5/008

See application file for complete search history.

(56) References Cited

U.S. PATENT DOCUMENTS

| | | | |
|---|---|---|---|
| 2,639,564 | A | 5/1953 | Atkin |
| 3,285,187 | A | 11/1966 | Anderson, Jr. |
| 3,793,776 | A | 2/1974 | Sadow, Jr. et al. |
| 4,095,375 | A | 6/1978 | Klebe et al. |
| 4,624,078 | A | 11/1986 | Van Rijen et al. |

(Continued)

FOREIGN PATENT DOCUMENTS

| | | | |
|---|---|---|---|
| CN | 201353721 | Y | 12/2009 |
| CN | 102959835 | A | 3/2013 |

(Continued)

OTHER PUBLICATIONS

International Search Report and Written Opinion of the Searching Authority for Application No. PCT/CN2013/088171, ISA/CN, Beijing China, mailed Aug. 26, 2014.

*Primary Examiner* — Timothy V Eley
(74) *Attorney, Agent, or Firm* — Stephen R. Valancius

(57) ABSTRACT

A sander may include a housing, a motor, a sanding platen, and a two-piece fan. The motor may be disposed within the housing and may include an output shaft. The sanding platen may be driven by the motor for movement relative to the housing. The fan may be driven by the motor and may include a first piece formed from a first material and a second piece formed from a second material. The first piece may include a disk-shaped body having first and second opposite sides. The first side may include a plurality of first blades extending therefrom. The second side may include a plurality of second blades extending therefrom and a recess formed therein. The second piece may be received in the recess and may include a counterweight boss formed thereon.

23 Claims, 6 Drawing Sheets

(56) References Cited

U.S. PATENT DOCUMENTS

| | | | | |
|---|---|---|---|---|
| 5,807,169 | A * | 9/1998 | Martin et al. | 451/357 |
| 5,813,903 | A * | 9/1998 | Amano et al. | 451/294 |
| 6,132,300 | A * | 10/2000 | Martin | 451/357 |
| 6,726,553 | B2 * | 4/2004 | Tiede et al. | 451/357 |
| 6,857,949 | B2 * | 2/2005 | Reich et al. | 451/357 |
| 6,875,095 | B2 * | 4/2005 | Walker | 451/357 |
| 6,942,558 | B2 * | 9/2005 | Wuensch | 451/357 |
| 7,104,873 | B1 * | 9/2006 | Borinato et al. | 451/159 |
| 7,270,591 | B2 | 9/2007 | Deshpande et al. | |
| 7,270,598 | B2 | 9/2007 | Dutterer et al. | |
| RE40,345 | E | 5/2008 | Duffy | |
| 7,534,165 | B2 | 5/2009 | Milbourne et al. | |
| 8,007,346 | B2 * | 8/2011 | Dehde et al. | 451/344 |
| 8,348,727 | B2 * | 1/2013 | Trautner et al. | 451/488 |
| 8,435,097 | B2 | 5/2013 | McRoberts et al. | |

FOREIGN PATENT DOCUMENTS

| | | | |
|---|---|---|---|
| DE | 3402062 | A1 | 8/1985 |
| EP | 1416164 | A2 | 5/2004 |
| JP | 2013188804 | A | 9/2013 |

* cited by examiner

SANDER HAVING TWO-PIECE FAN

FIELD

The present disclosure relates to a sander having a two-piece fan.

BACKGROUND

This section provides background information related to the present disclosure and is not necessarily prior art.

An electric sander may include a housing and a motor-driven sanding platen. The housing may define a handle and/or a gripping surface enabling a user to manipulate the sander and apply the sander to a workpiece. The sanding platen may be driven in a reciprocating path or in an orbital path relative to the housing.

The sander may include a fan that cools the motor during operation of the sander. Such fans are typically molded or cast as a single monolithic body from a single material. Fans that are cast from a metallic material are typically stronger and more durable than molded plastic fans. It is desirable for the fan to be as rotationally balanced as possible, however, tight dimensional tolerances can be difficult to achieve through casting.

SUMMARY

This section provides a general summary of the disclosure, and is not a comprehensive disclosure of its full scope or all of its features.

In one form, the present disclosure provides a sander that may include a housing, a motor, a sanding platen, and a two-piece fan. The motor may be disposed within the housing and may include an output shaft. The sanding platen may be driven by the motor for movement relative to the housing. The fan may be driven by the motor and may include a first piece formed from a first material and a second piece formed from a second material. The first piece may include a disk-shaped body having first and second opposite sides. The first side may include a plurality of first blades extending therefrom. The second side may include a plurality of second blades extending therefrom and a recess formed therein. The second piece may be received in the recess and may include a counterweight boss formed thereon.

In some embodiments, the second piece may include an integrally formed hub and drive shaft. The hub may engage the output shaft. The drive shaft may extend from the hub and may be eccentric relative to the output shaft. The drive shaft may drivingly engage the sanding platen.

In some embodiments, the output shaft may extend through a central aperture of the first piece.

In some embodiments, the second piece may include at least one third blade extending away from the first side.

In some embodiments, the first piece may be formed from a polymeric material and the second piece may be formed from a cast metal.

In some embodiments, the first blades may force air across the motor while the fan is rotating, and the second blades may draw dust into a dust collection unit while the fan is rotating.

In some embodiments, the first piece may include staking bosses extending out of the recess and through corresponding apertures in the second piece.

In some embodiments, the counterweight boss may be disposed between the drive shaft and a radially outer periphery of the second piece.

In some embodiments, the second piece may include another counterweight boss integrally formed thereon. The counterweight bosses may be disposed at radially opposite ends of the second piece from each other.

In some embodiments, one of the counterweight bosses may be received in the recess and the other counterweight boss may extend outward from a side of the second piece that faces away from the recess.

In another form, the present disclosure provides a sander that may include a housing, a motor, a sanding platen, and a two-piece fan. The motor may be disposed within the housing and may include an output shaft. The sanding platen may be driven by the motor for movement relative to the housing. The two-piece fan may be disposed within the housing and may include a first piece formed from a first material and a second piece formed from a second material. The first piece may include first and second opposite sides and a central aperture extending through the first and second sides. The first side may include a recess formed therein. The second piece may be received in the recess and may include an integrally formed hub and an integrally formed drive shaft. The hub may engage the output shaft. The drive shaft may be eccentric relative to the output shaft and may drivingly engage the sanding platen.

In some embodiments, the second piece may include a counterweight boss formed thereon.

In some embodiments, the counterweight boss may be disposed between the drive shaft and a radially outer periphery of the second piece.

In some embodiments, the second piece may include another counterweight boss integrally formed thereon. The counterweight bosses may be disposed at radially opposite ends of the second piece from each other.

In some embodiments, one of the counterweight bosses may be received in the recess and the other counterweight boss may extend outward from a side of the second piece that faces away from the recess.

In some embodiments, the output shaft may extend through the central aperture of the first piece.

In some embodiments, the first and second sides may each include a plurality of blades. The second piece may include at least one blade extending away from the first side.

In some embodiments, the blades extending from the first side may force air across the motor while the fan is rotating, and the blades extending from the second side may draw dust into a dust collection unit while the fan is rotating.

In some embodiments, the first piece may be formed from a polymeric material and the second piece may be formed from a cast metal.

In some embodiments, the first piece may include staking bosses extending out of the recess and through corresponding apertures in the second piece.

In another form, the present disclosure provides a power tool that may include a housing, a motor, a tool, and a two-piece fan. The motor may be disposed within the housing and may include an output shaft. The tool may be driven by the motor for movement relative to the housing. The tool may be configured to remove material from a workpiece. The two-piece fan may be disposed within the housing and may include a first piece formed from a polymeric material and a second piece formed from a metal. The second piece may fixedly engage the first piece and may include an integrally formed drive shaft and an integrally formed counterweight. The second piece may engage the output shaft. The drive shaft may be eccentric relative to the output shaft and may drivingly engage the tool.

In some embodiments, the first piece may include a recess in which the second piece is received.

In some embodiments, the second piece may include another counterweight boss integrally formed thereon. The counterweight bosses may be disposed at radially opposite ends of the second piece from each other.

In some embodiments, the first piece may include a central aperture extending therethrough. The output shaft may extend through the central aperture.

In some embodiments, first and second opposite sides of the first piece may each include a plurality of blades. The second piece may also include at least one blade.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
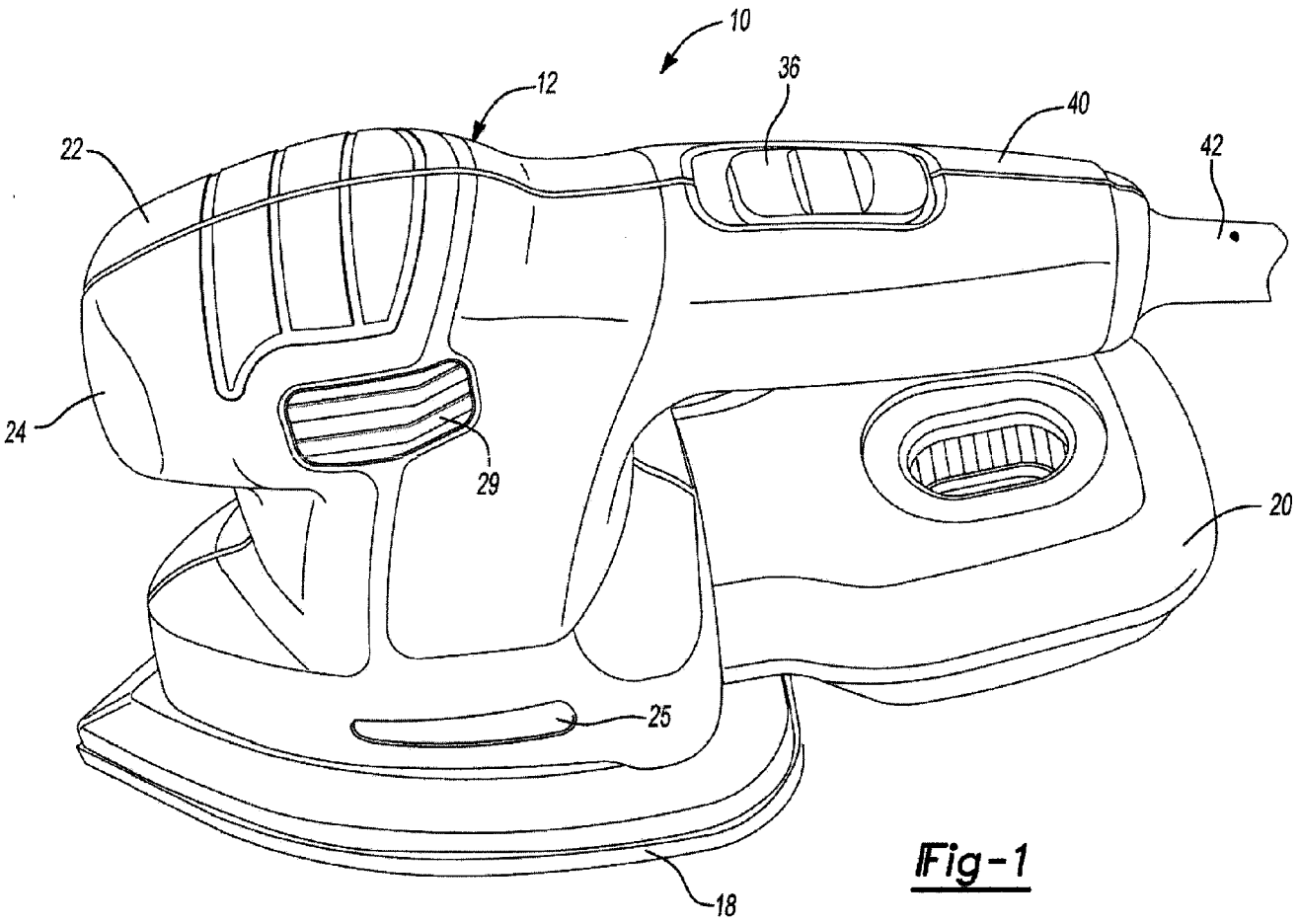
FIG. 1 is a perspective view of a sander according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
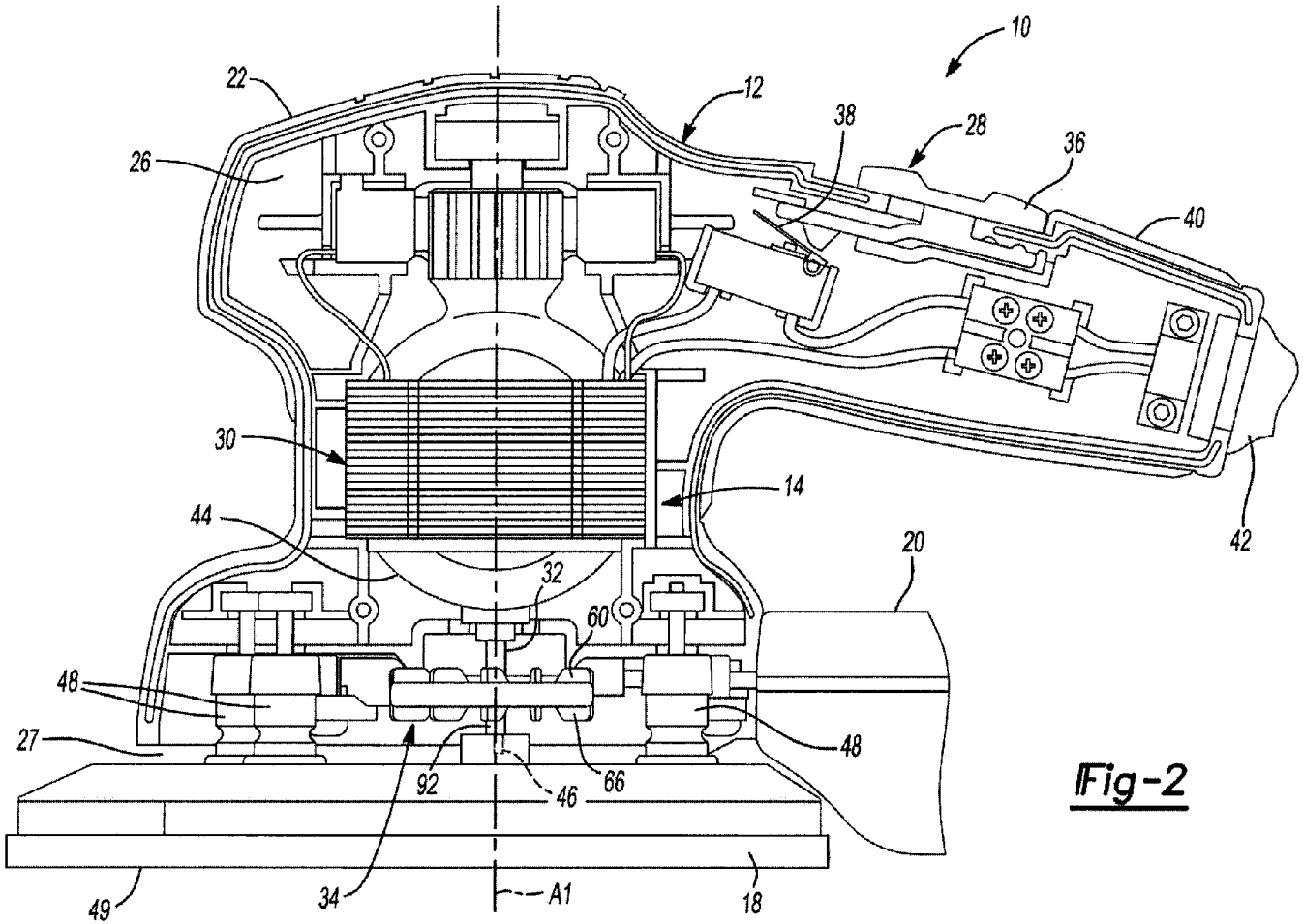
FIG. 2 is a cross-sectional view of the sander of FIG. 1.
Figure 3:
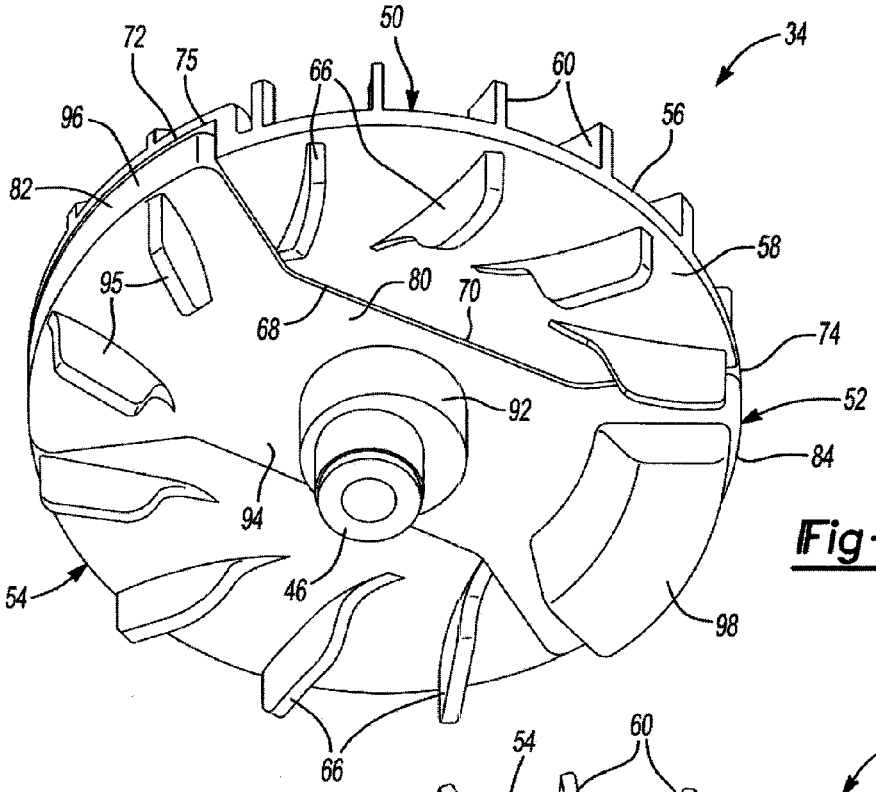
FIG. 3 is a first perspective view of a two-piece fan of the sander.
Figure 4:
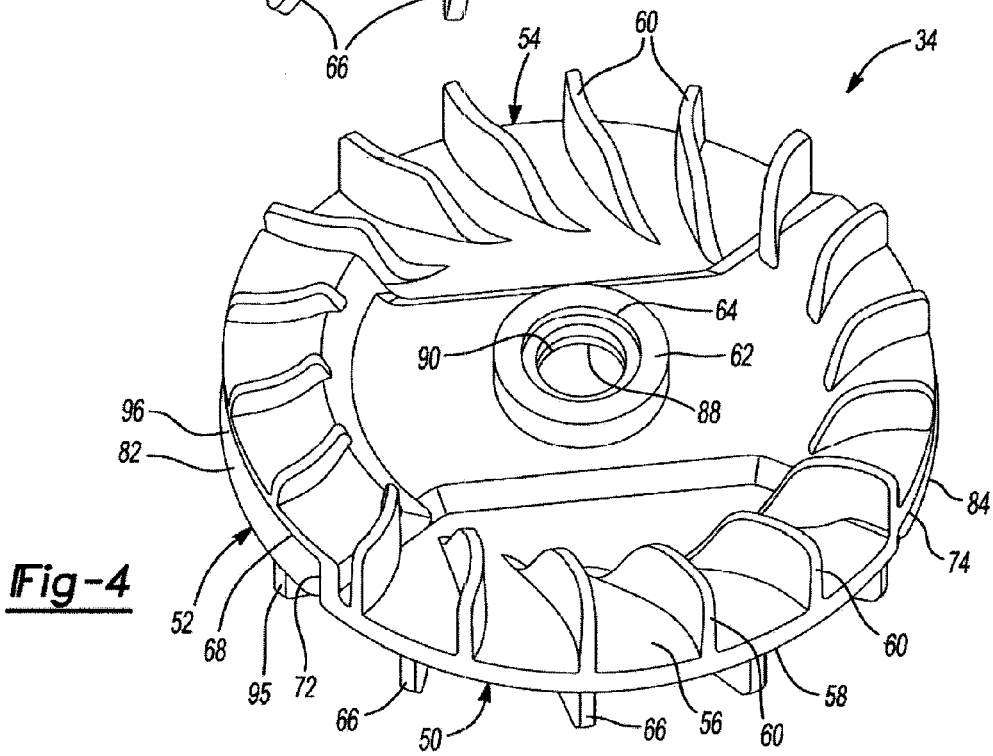
FIG. 4 is a second perspective view of the two-piece fan.

With reference to FIGS. 1 and 2, a sander 10 is provided that may include a housing 12, a drive system 14, a sanding platen 18 and a dust collection unit 20. The housing 12 may include first and second shell portions 22, 24 cooperating to define a cavity 26 in which the drive system 14 may be disposed. As will be described in more detail below, the drive system 14 may drive the sanding platen 18 in an orbital path relative to the housing 12 to sand and/or otherwise remove material from a workpiece. The dust collection unit 20 may collect material removed from the workpiece by the sanding platen 18 during operation of the sander 10.

The drive system 14 may include a switch assembly 28, a motor 30, a motor output shaft 32, and a two-piece fan 34. The switch assembly 28 may include a switch member 36 and a contact 38. The switch member 36 may be disposed on or near a handle 40 of the housing 12 and is movable relative to the housing 12 by a user to cause the contact 38 to move between first and second positions to prevent and allow electrical communication between a power source and the motor 30.

While the drive system 14 shown in the figures receives electrical power from an external source (e.g., an electrical outlet of a house or building) via a power cord 42, in some embodiments, the sander 10 may include a battery pack that provides electrical power to the motor 30.

The output shaft 32 may be attached to a rotor 44 of the motor 30 and may be rotatable therewith about a longitudinal axis A1 of the output shaft 32 and rotor 44 in response to the motor 30 receiving electrical current. It will be appreciated that, in some embodiments, the motor 30 could be a variable-speed motor operable to rotate the output shaft 32 at any of a plurality of speeds that are selectable by the user. The output shaft 32 may be attached to the fan 34 so that the fan 34 rotates therewith about the longitudinal axis A1. As will be described in more detail below, the fan 34 may include a drive shaft 46 that is eccentric relative to the output shaft 32 so that the drive shaft 46 moves in an orbital path about the longitudinal axis A1.

The drive shaft 46 may drivingly engage the sanding platen 18 to move the sanding platen 18 in an orbital path relative to the housing 12. The sanding platen 18 may be attached to the housing 12 by a plurality of legs 48 that support the sanding platen 18 relative to the housing 12 while allowing the orbital movement of the sanding platen 18 relative to the housing 12. A bottom surface 49 of the sanding platen 18 may include an abrasive medium formed thereon or attached thereto (e.g., sand paper) and may be held in contact with a workpiece by the user to sand the workpiece during operation of the motor 30.

Referring now to FIGS. 3-7, the fan 34 will be described in detail. The fan 34 has a two-piece construction including a first piece 50 and a second piece 52. The first piece 50 may be a single monolithic body molded and/or otherwise formed from a polymeric material, for example. The second piece 52 may be a single monolithic body cast and/or otherwise formed from a metallic material, for example. In some embodiments, the second piece 52 may be cast from zinc or aluminum. In some embodiments, the mass of the second piece 52 may be more than half of the total mass of the fan 34. In some embodiments, the second piece 52 may be about sixty percent or more of the total mass of the fan 34.

The first piece 50 may include a generally disk-shaped body 54 having first and second opposing sides 56, 58. The first side 56 may include a plurality of first blades 60 extending upwardly away from the second side 58 and arranged in a circular array about the longitudinal axis A1. A hub 62 (FIG. 4) may extend axially upward from the first side 56 and may define a central aperture 64 that extends through the body 54. The hub 62 and the central aperture 64 may be centered on the longitudinal axis A1.

Figure 5:
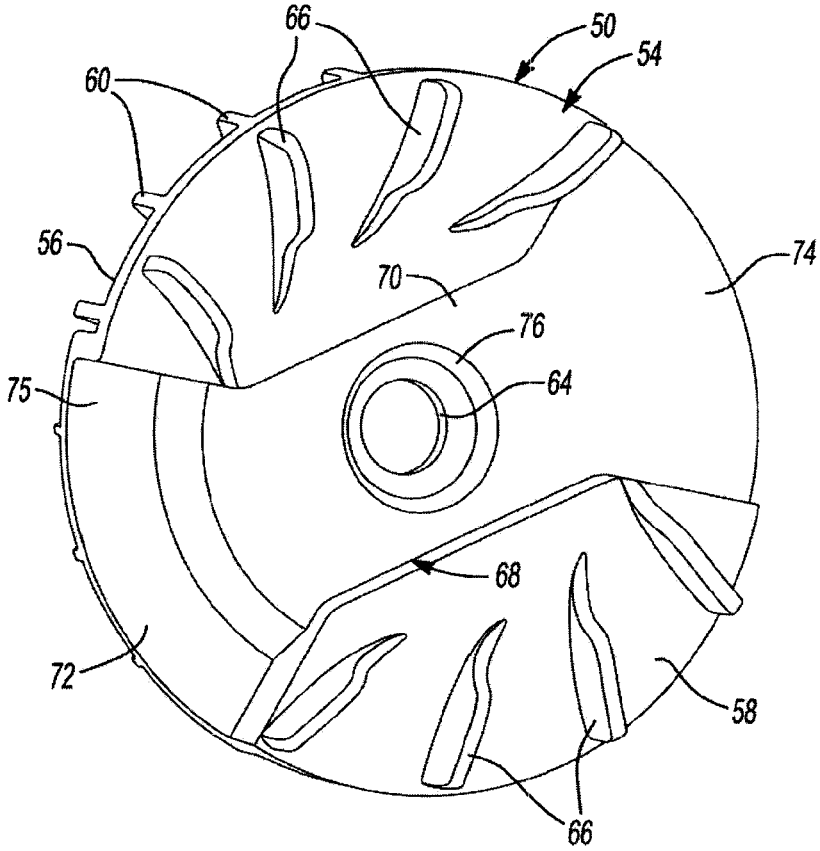
FIG. 5 is a perspective view of a first piece of the two-piece fan.
Figure 6:
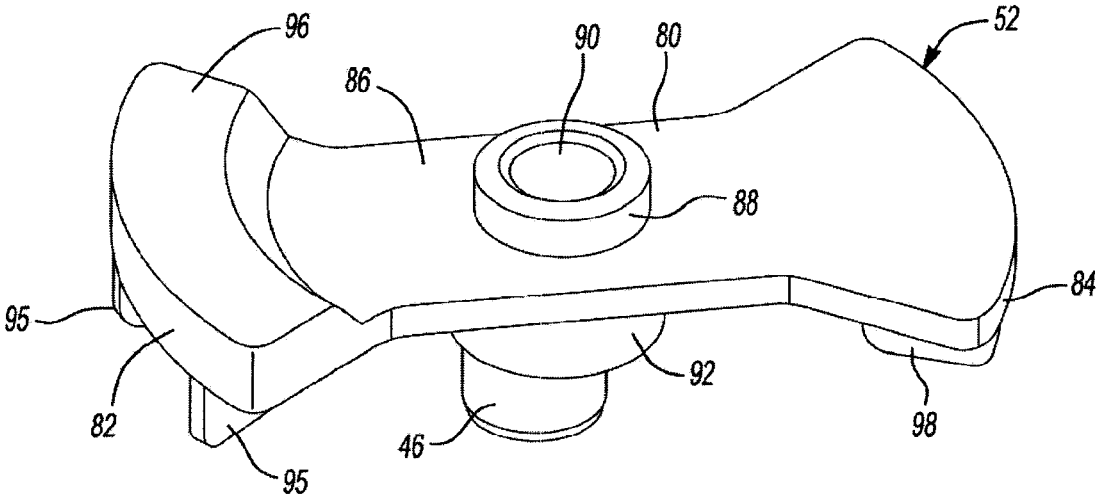
FIG. 6 is a first perspective view of a second piece of the two-piece fan.
Figure 7:
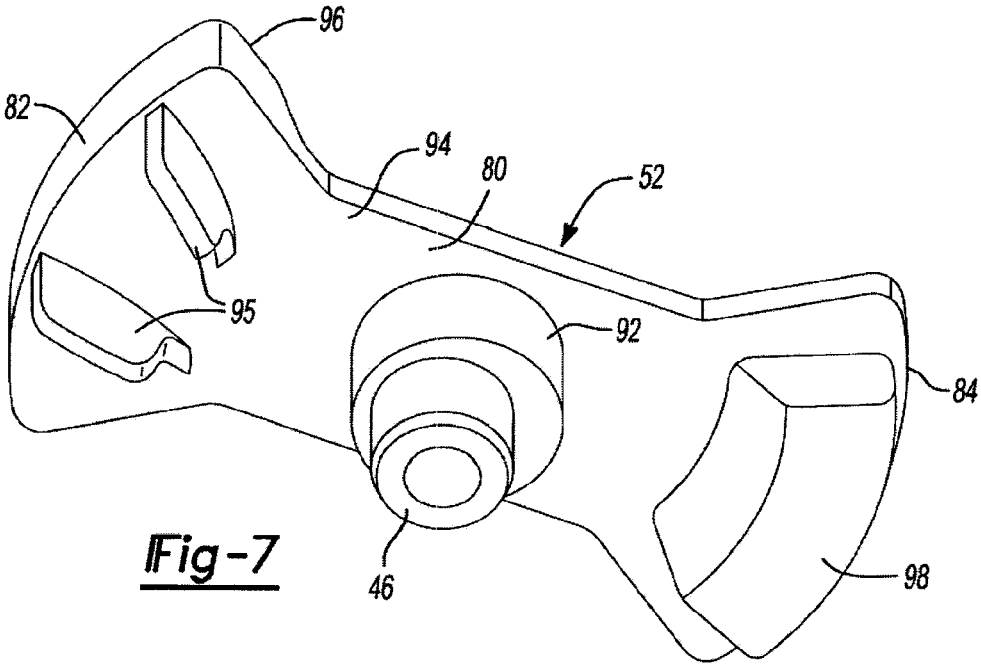
FIG. 7 is a second perspective view of the second piece of the two-piece fan.

The second side 58 may include a plurality of second blades 66 extending downward and away from the first side 56 and arranged in a partial circular array about the longitudinal axis A1. A recess 68 may be formed in the second side 58. The recess 68 may have a depth that is approximately equal to a thickness of the second piece 52 of the fan 34. The recess 68 may include a central portion 70 and first and second flared radial ends 72, 74. As shown in FIG. 5, the first end 72 includes a portion 75 (FIGS. 3 and 5) having greater depth than the central portion 70 and the second end 74 to accommodate the shape of the second piece 52. An annular recess 76 (FIG. 5) may be formed in the central portion 70. The annular recess 7 may extend around and be concentric with the central aperture 64.

The second piece 52 may be received in the recess 68 and may include a central portion 80 and first and second flared radial ends 82, 84. A first side 86 (FIG. 6) of the second piece 52 may include a central hub 88 having an aperture 90 therein. The central hub 88 may be received in the annular recess 76 formed in the recess 68 of the first piece 50 so that the aperture 90 is substantially concentric with the central aperture 64 of the first piece 50. In some embodiments, the aperture 90 may extend into a hub 92 extending axially from a second side 94 (FIG. 7) of the second piece 52. The motor output shaft 32 may extend through the central aperture 64 of the first piece 50 and may fixedly engage the aperture 90 of the hub 92 of the second piece 52 (e.g., by threaded engagement and/or any other suitable means). The eccentric drive shaft 46 may extend downwardly from the hub 92 and is eccentric relative to the hubs 88, 92 and the aperture 90.

The second end 82 may include one or more third blades 95 that extend downward from the second side 94. The third blades 95 may be arranged in such a manner that they generally continue the partial circular pattern of the second blades 66 of the first piece 50.

A first counterweight boss 96 may be formed on the first end 82 and may extend upward from the first side 86. The first counterweight boss 96 may be received in the portion 75 of the first end 72 of the recess 68 in the first piece 50. A second counterweight boss 98 may be formed on the second end 84 and may extend downwardly from the second side 94 (i.e., in a direction opposite the first counterweight boss 96). In some embodiments, the second counterweight boss 98 may have a mass that is greater than a mass of the first counterweight boss 96. In other embodiments, the second counterweight boss 98 may have a mass that is less than a mass of the first counterweight boss 96. The masses and positions of counterweight bosses 96, 98 may be selected to counterbalance the orbital motion of the sanding platen 18.

The second piece 52 may be fixedly retained in the recess 68 of the first piece 50 by any suitable means. For example, the second piece 52 could be fixed to the first piece 50 by a press fit, welding, staking, heat-staking, shrink-fitting, overmolding the first piece 50 onto the second piece 52, adhesive bonding, riveting, and/or one or more threaded fasteners.

During operation of the motor 30, rotation of the motor output shaft 32 causes corresponding rotation of the fan 34, which causes the drive shaft 46 of the fan 34 to orbit about the longitudinal axis A1 to drive the sanding platen 18 in an orbital path relative to the housing, as described above. As the fan 34 rotates, the upwardly extending first blades 60 draw air into the cavity 26 through one or more openings 25 (FIG. 1) in the housing 12 and/or through a gap 27 (FIG. 2) between the housing 12 and the sanding platen 18 and force the air across the motor 30 to cool the motor 30. The housing 12 may include one or more vents 29 (FIG. 1) to facilitate airflow through the cavity 26. Simultaneously, the downwardly extending second and third blades 66, 95 of the fan 34 may draw material removed from the workpiece through the openings 25 and/or gap 27 and force the material into the dust collection unit 20.

Providing the fan 34 with the two-piece construction described above provides advantages over forming the fan 34 as a single monolithic body. For example, dimensional tolerances of the fan 34 can be improved by forming the first piece 50 of the fan 34 from a polymeric material and forming the second piece 52 from a metallic material. Because the formation and positioning of the counterweight bosses 96, 98 relative to the drive shaft 46 and the hubs 88, 92 may be critical to minimizing vibration, it may be beneficial to improve dimensional control of the portion of the fan 34 that includes these features. Therefore, reducing the overall size and mass of the unitary body that includes these features reduces deviations from a nominal mass of the unitary body. For example, if a fan cast from a given metal as a single unitary body has a nominal mass tolerance of plus or minus 1.5 grams, then forming the fan from two pieces—only one of which being formed from the given metal—may reduce the mass tolerance of the cast metal piece to approximately plus or minus 1.0 grams.

Furthermore, by forming the first piece 50 of the fan 34 from a polymeric material and forming the second piece 52 from a metallic material, the overall mass of the fan 34 can be reduced (compared to a fan formed entirely of metal) while maintaining the strength and durability of critical features, such as the drive shaft 46 and the hubs 88, 92 that engage the output shaft 32. The reduced overall mass reduces the amount of power necessary to drive sanding platen 18. Furthermore, forming the fan 34 partially from a polymeric material may reduce the cost of manufacturing the fan 34 relative to a fan formed entirely from a metallic material.

Figure 8:
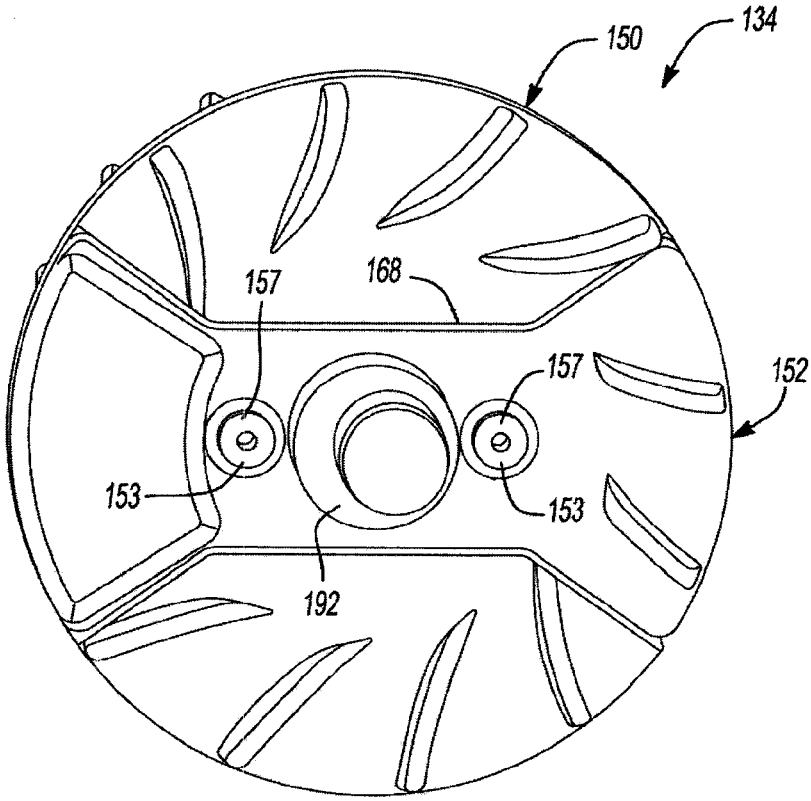
FIG. 8 is a perspective view of another two-piece fan according to the principles of the present disclosure.
Figure 9:
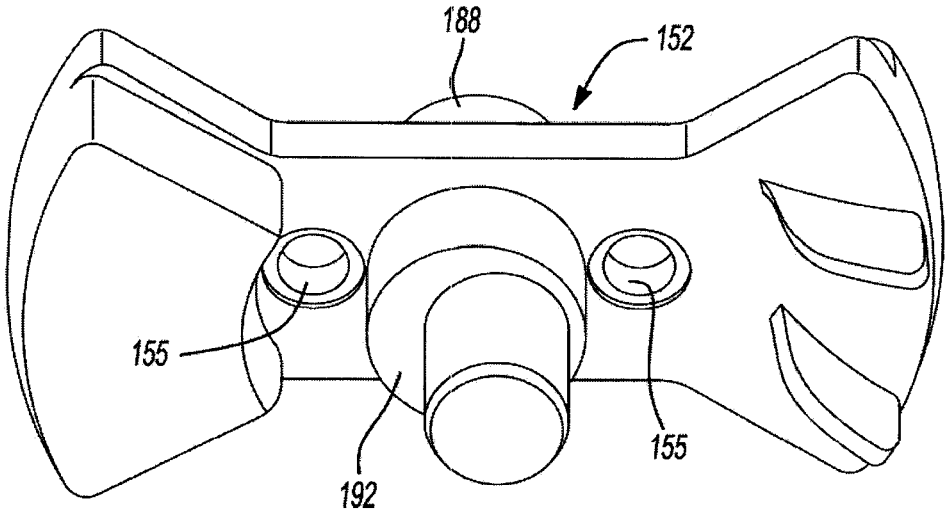
FIG. 9 is a perspective view of one of the pieces of the two-piece fan of FIG. 8.

With reference to FIGS. 8 and 9, another two-piece fan 134 is provided that may be incorporated into the sander 10 in place of the fan 34. Like the fan 34, the fan 134 may include first and second pieces 150, 152. The structure and functions of the first and second pieces 150, 152 may be similar or identical to that of the first and second pieces 50, 52 described above, apart from any exceptions described below and/or shown in the figures. Therefore, similar features will not be described again in detail.

The first piece 150 may include a recess 168 (similar or identical to the recess 68 described above) and one or more staking bosses 153 extending out of the recess 168 in a direction parallel to a longitudinal axis of the fan 134. Each of the staking bosses 153 may extend through a corresponding aperture 155 formed in the second piece 152. The apertures 155 may be disposed adjacent hubs 188, 192. With the second piece 152 received in the recess 168 such that the staking bosses 153 are extending through the apertures 155, distal ends 157 of the staking bosses 153 may be heat-staked to deform the distal ends 157, thereby creating an interference to prevent removal of the second piece 152 from the recess 168.

While the fans 34, 134 are described above as being incorporated into the sander 10, it will be appreciated that either of the fans 34, 134 could be incorporated into other power tools having an eccentric drive shaft for driving a tool in an orbital path. For example, either of the fans 34, 134 could be incorporated into a polishing tool or a grinding tool.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sander comprising:

a housing;

a motor disposed within the housing and including an output shaft;

a sanding platen driven by the motor for movement relative to the housing; and a two-piece fan driven by the motor and including a first piece formed from a first material and a second piece formed from a second material, the first piece including a disk-shaped body having first and second opposite sides, the first side including a plurality of first blades extending therefrom, the second side including a plurality of second blades extending therefrom and a recess formed therein, the second piece received in the recess and including a counterweight boss formed thereon.

2. The sander of claim 1, wherein the second piece includes an integrally formed hub and drive shaft, the hub engaging the output shaft, the drive shaft extending from the hub and eccentric relative to the output shaft, the drive shaft drivingly engaging the sanding platen.

3. The sander of claim 2, wherein the output shaft extends through a central aperture of the first piece.

4. The sander of claim 1, wherein the second piece includes at least one third blade extending away from the first side.

5. The sander of claim 1, wherein the first piece is formed from a polymeric material and the second piece is formed from a cast metal.

6. The sander of claim 1, wherein the first blades force air across the motor while the fan is rotating and the second blades draw dust into a dust collection unit while the fan is rotating.

7. The sander of claim 1, wherein the first piece includes staking bosses extending out of the recess and through corresponding apertures in the second piece.

8. The sander of claim 1, wherein the second piece includes another counterweight boss integrally formed thereon, the counterweight bosses disposed at radially opposite ends of the second piece from each other.

9. The sander of claim 8, wherein one of the counterweight bosses is received in the recess and the other counterweight boss extends outward from a side of the second piece that faces away from the recess.

10. A sander comprising:

a housing;

a motor disposed within the housing and including an output shaft;

a sanding platen driven by the motor for movement relative to the housing; and a two-piece fan disposed within the housing and including a first piece formed from a first material and a second piece formed from a second material, the first piece having first and second opposite sides and a central aperture extending through the first and second sides, the first side including a recess formed therein, the second piece received in the recess and including an integrally formed hub and an integrally formed drive shaft, the hub engaging the output shaft, the drive shaft being eccentric relative to the output shaft and drivingly engaging the sanding platen.

11. The sander of claim 10, wherein the second piece includes a counterweight boss formed thereon between the drive shaft and a radially outer periphery of the second piece.

12. The sander of claim 11, wherein the second piece includes another counterweight boss integrally formed thereon, the counterweight bosses disposed at radially opposite ends of the second piece from each other.

13. The sander of claim 12, wherein one of the counterweight bosses is received in the recess and the other counterweight boss extends outward from a side of the second piece that faces away from the recess.

14. The sander of claim 10, wherein the output shaft extends through the central aperture of the first piece.

15. The sander of claim 10, wherein the first and second sides each include a plurality of blades, and wherein the second piece includes at least one blade extending away from the first side.

16. The sander of claim 15, wherein the blades extending from the first side force air across the motor while the fan is rotating and the blades extending from the second side draw dust into a dust collection unit while the fan is rotating.

17. The sander of claim 10, wherein the first piece is formed from a polymeric material and the second piece is formed from a cast metal.

18. The sander of claim 10, wherein the first piece includes staking bosses extending out of the recess and through corresponding apertures in the second piece.

19. A power tool comprising:

a housing;

a motor disposed within the housing and including an output shaft;

a tool driven by the motor for orbital movement relative to the housing, the tool configured to remove material from a workpiece; and a two-piece fan disposed within the housing and including a first piece formed from a polymeric material and a second piece formed from a metal, the second piece fixedly engaging the first piece and including an integrally formed drive shaft and an integrally formed counterweight boss, the second piece engaging the output shaft, the drive shaft being eccentric relative to the output shaft and drivingly engaging the tool.

20. The power tool of claim 19, wherein the first piece includes a recess in which the second piece is received.

21. The power tool of claim 19, wherein the second piece includes another counterweight boss integrally formed thereon, the counterweight bosses disposed at radially opposite ends of the second piece from each other.

22. The power tool of claim 19, wherein the first piece includes a central aperture extending therethrough, and wherein the output shaft extends through the central aperture.

23. The power tool of claim 19, wherein first and second opposite sides of the first piece each include a plurality of blades, and wherein the second piece includes at least one blade.

* * * * *